United States Patent [19]

Laing et al.

[11] Patent Number: 4,917,142

[45] Date of Patent: Apr. 17, 1990

[54] SECONDARY CIRCULATION UNIT

[76] Inventors: Nikolaus L. Laing; Ludwig Ludin, both of 632 Marsat Court, Chula Vista, Calif. 92011

[21] Appl. No.: 414,392

[22] Filed: Sep. 29, 1989

[51] Int. Cl.[4] ..... F16L 5/00; F24H 1/00

[52] U.S. Cl. ..... 137/337; 137/563; 137/564; 137/566; 126/362

[58] Field of Search ..... 137/565, 566, 334, 337, 137/563, 564, 341; 4/192; 126/362, 13 A; 122/13 A

[56] References Cited

U.S. PATENT DOCUMENTS

| | | | |
|---|---|---|---|
| 1,033,588 | 7/1912 | Hopkins | 126/362 |
| 1,401,523 | 12/1921 | Coates | 237/19 |
| 2,007,872 | 7/1935 | Oliphant | 126/362 |
| 2,255,460 | 9/1941 | Weaver | 137/564 |
| 2,922,469 | 1/1960 | Rowe | 158/36 |
| 2,967,666 | 1/1961 | Carlson | 236/12 |
| 2,971,532 | 2/1961 | McLaren et al. | 137/592 |
| 4,037,567 | 7/1977 | Torres | 137/563 |
| 4,116,379 | 9/1978 | Movick | 237/1 A |
| 4,293,093 | 10/1981 | Raymond et al. | 237/19 |
| 4,672,990 | 6/1987 | Robillard | 137/337 |
| 4,759,382 | 7/1988 | Harel | 137/334 |

FOREIGN PATENT DOCUMENTS

| | | | |
|---|---|---|---|
| 255962 | 5/1963 | Australia . | |
| 0023236 | 2/1979 | Japan | 137/334 |
| 118165 | 2/1947 | Sweden . | |
| 745262 | 2/1966 | United Kingdom . | |

*Primary Examiner*—A. Michael Chambers
*Attorney, Agent, or Firm*—Henri J. A. Charmasson

[57] ABSTRACT

A device for effecting secondary circulation of water into a hot water tank not having a return opening. The arms of a T-fitting are place in series with the distribution line near the outlet port of the water tank. A return line, continuous at one end with the distal portion of the distribution line, is continuous at the other end with a relatively small internal line which lies within the leg of the T-fitting, one arm of the T-fitting, and extending through the outlet port into the water tank. A relatively low power pump and a sinking-ball valve are placed in series with the return line to cause the flow of water in the secondary circulation system to flow in one direction only.

6 Claims, 1 Drawing Sheet

SECONDARY CIRCULATION UNIT

BACKGROUND OF THE INVENTION

This invention relates to the heating of water pipes through a secondary circulation of water.

DESCRIPTION OF THE RELATED ART

In order to provide the immediate flow of hot water at all hot water outlets and prevent freezing of pipes, hot water from a water tank is circulated at a slow speed by a circulation pump. This presents two basic problems. First, the water returning from the hot water distribution line to the water tank must have some means of reentering the tank. Second, the flow of water must be in one direction only to insure that the faucets do not deliver the cooler water from the return means.

Regarding the reentry of water into the hot water tank, this usually requires an opening in the wall of the tank in its lower, cooler region. A disadvantage of prior secondary circulation systems is that the installation can be done only if the tank has connectors for return flow.

Regarding the direction of flow, the installation of a secondary circulation system requires a check-valve between the tank and the pressure side of the pump. This check valve prevents the back flow of cold Water to and open faucet from said lower region of the tank. Since these check-valves require a pressure to open which is much higher than the pressure necessary to overcome the friction of the circulation loop, a disadvantage of prior systems is that the pressure must be provided by the pump which therefore requires a considerably larger motor and energy consumption than would be necessary for the circulation of the water.

SUMMARY OF THE INVENTION

It is among the objects and advantages of the present invention to provide an efficient and energy saving secondary circulation system which returns water to the hot water tank through the hot water outlet, and which utilizes a relatively small, low cost circulation pump. According to the invention, the return of water to the tank is accomplished in the following manner. A T-fitting with three arms is placed near the hot water outlet of the tank, with two of its arms in series with the distribution line. A return line in series with a circulation pump is connected to the third arm continuous at one end with the distal portion of the distribution line. The pump is continuous at its other end with a small gauge line mounted inside the arm of the T-fitting, and extending into the top of the water tank.

By these means both disadvantages of prior circulation systems are eliminated because the reentering water penetrates through the higher hot layer into the cooler region of the tank, therefore it avoids the reentry opening in a lower region of the tank. In addition no cooler water will be back-fed to the faucet because the return line ends in the upper hot layer of the tank. Therefore, only hot water can enter the return line, in case of back flow. If a check-valve seems desirable, because the water pressure of the main is so high that the pump can be damaged, the invention provides a special check-valve which does not require pump pressure for opening.

In the present invention, a sinking-ball valve is used in place of a conventional spring-check valve. Since the sinking-ball valve is not spring loaded, it presents minimal additional resistance to the return flow of water, and eliminates the requirement for a high pressure pump to generate sufficient water pressure to open the valve.

The combination of the T-fitting, having a relatively small line for return of water to the water tank, and the floating-ball valve, obviates the need for a large diameter return line. Any air in the return line will easily move through the pump, past the sinking-ball valve, and into the tank. Air in the tank will be expelled at a faucet or other water outlet in the normal fashion. Experimentation has shown that by the use of the present invention, the return line is functional where its cross sectional diameter is only 10% of the cross sectional diameter of the distribution line. The small diameter return line minimizes interference with the water flowing through the distribution line and also heat losses.

It is within this scope and spirit of the present invention to incorporate an electrical control for energizing the pump at various times of the day, and Whenever the water or ambient temperature falls below a certain threshold temperature. An alternative version of the invention utilizes two pumps, one for hot water circulation, and one for cold water circulation, to prevent ice build up in the cold water system.

DESCRIPTION OF THE PREFERRED EMBODIMENT

Figure 1:
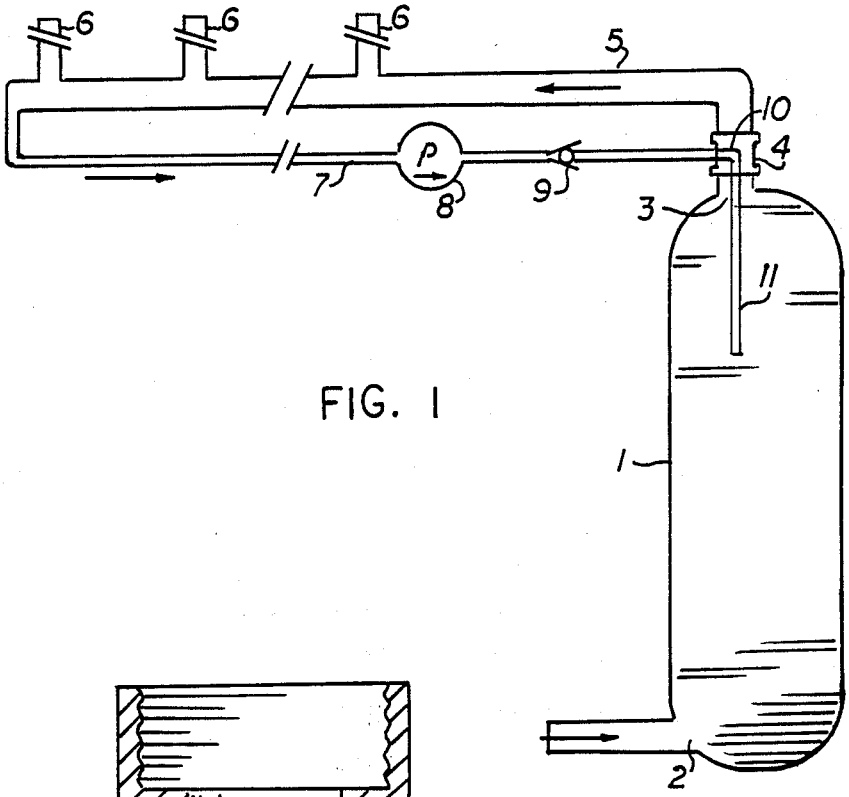
FIG. 1 is a diagrammatic view of the secondary circulation system.

Turning now to the drawings, FIG. 1 depicts a schematic of the present invention. A water tank 1 has an inlet port 2 for cold water entering the tank, and an outlet port 3 for hot water exiting the tank. Primary circulation of the water occurs when hot water exits the tank 1 at outlet 3, flows through the T-connecter 4, the distribution line 5, and the faucets 6. In the operation of the present invention, secondary circulation also occurs along the following path:

From the tank 1, through the outlet port 3, the arms of the T-connector 4, the distribution line 5, past the faucets 6, the return line 7, the pump 8, the sinking-ball valve 9, the internal tube 10, the dip tube 11, and back into the tank 1. The internal line 10, lies within the leg and one arm of the T-connector 4, extends through the outlet port 3, and is continuous at one end with the return line 7 and its other end forming a dip tube 11. Thus, the invention utilizes the same outlet port 3 for both hot water flowing through the distribution lines 5 and for cooled water returning to the tank 1 via the return line 7. By this means, the present invention can be installed on the vast majority of hot Water tanks which are not equipped with a special return opening. It is understood that the sinking ball valve 9 is only necessary if the pressure drop caused by fully open faucets may damage the pump.

Figure 2:
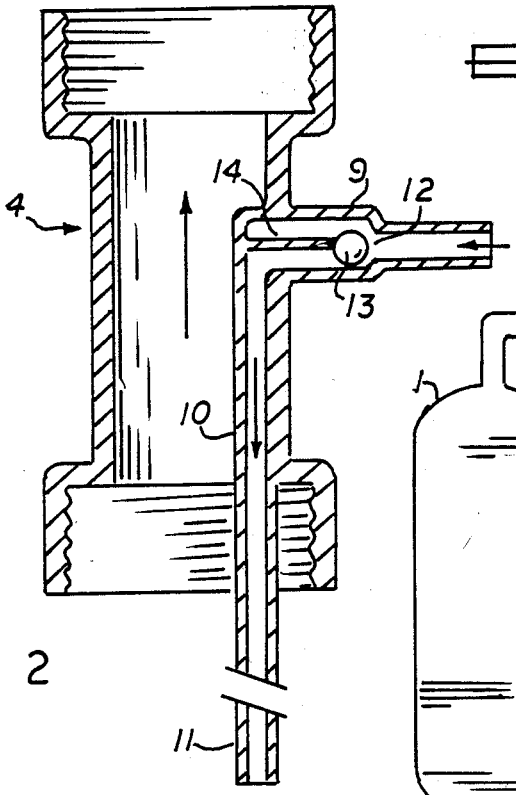
FIG. 2 is a cross-sectional view of the valve and T-fitting assembly.

The return line 7 is preferably made from plastic or copper for convenience and cost in laying the line. The internal line 10 is preferably made of stainless steel, and is braised into the leg of the T-connector 4 as illustrated in FIG. 2. The internal line 10 has a cross-section which is only 10% of the diameter of the distribution line 5. The small size of the internal line allows water to flow essentially unimpeded within the primary circulation, but is still sufficiently large to accommodate the secondary circulation.

The sinking-ball valve 9 is shown in a vertical cross section in FIG. 2. The non-concentric opening 12 of the valve 9 is slightly larger than the diameter of the ball 13. The limiting wall 14 restricts the movement of the ball 13. When water is flowing from the pump 8 to the valve 9, the ball 13 rises away from the flow path, and the water passes with essentially no drop in pressure. Conversely, when water attempts to flow from the valve 9 to the pump 8 the ball 13 drops into the flow path, engages the opening 12 and prevents the flow of water. Since the sinking-ball valve 9 operates with essentially no pressure drop, a relatively low powered pump 8 can be utilized in combination with a relatively small return line 7 and a small internal line 10. In the removal of air from the system, at least one of the faucets 6 is opened. Air within the system will follow the flow of water outlined above for the secondary circulation system, eventually exiting the system at the faucet 6.

In the operation of the system, standard electrical controls (not shown) are used to engage the pump. The control options include engaging the pump based on a timer, on water temperature at some point along the distribution or return lines, or in a de-icing mode involving both a timer and a temperature sensor, where the pump is engaged periodically for short periods to bring the coolest water in contact with the temperature sensor.

Figure 3:
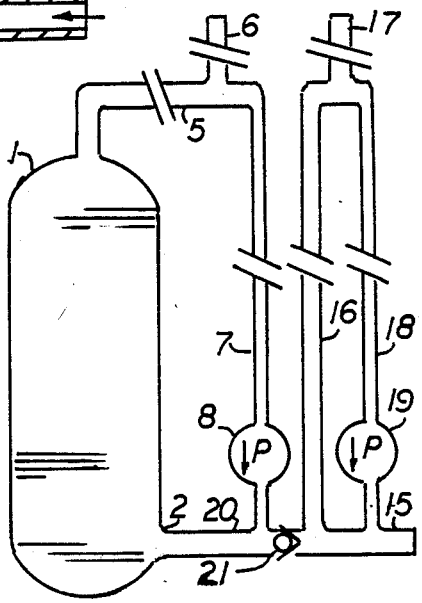
FIG. 3 is a diagrammatic view of a two pump system.

FIG. 3 is a schematic identifying an alternative embodiment for circulation of both hot and cold water using two pumps 8 and 19. In the hot water circulation, hot water flows from the tank 1 through outlet port 3 and into the hot water distribution line 5, past the hot water faucet 6, through the hot water return line 7, the hot water pump 8, the access line 20, and into the tank at the cold water inlet port 1. In the cold water circulation, the cold water flows through cold water distribution line 16, past the cold water faucet 17, through the cold water return line 18, the cold water pump 19, the access line 20, and back into the cold distribution line 16. A check valve 21 in access line 20 prevents hot water from flowing out the cold water faucet 17 when the hot water pump 8 is engaged and the cold water faucet 17 is open.

When either of the pumps 8 and 19 are engaged without the other pump being engaged, there is essentially no mixing of hot and cold Water. When both of the pumps 8 and 19 are engaged, there will be some mixing of hot and cold water in the access line 20.

What is claimed is:

1. A water circulation system for a commercial or domestic building having a hot water distribution line and a hot water tank having a heat source, a cold water inlet port and a hot water outlet port in the water section of the tank, said system comprising:

a T-connector having two arms and a leg;

the two arms being placed in series with the distribution line near the outlet port;

an internal line extending through the leg, past one arm of the T-connector, through the outlet port, and into the upper region of the water tank;

a return line continuous at one end with the distal end of the distribution line, and at its other end with the internal line; and a pump placed in series with the return line.

2. The system of claim 1 wherein the internal cross-section of the internal line is approximately 10% of the internal cross-section of the distribution line.

3. The system of claim 1 which further comprises a check valve in said return line between the pump and the T-connector.

4. The system of claim 3 wherein said check valve is integral with said T-connector.

5. The system of claim 4 wherein said check valve comprises a sinking-ball.

6. The system of claim 4 wherein said check valve further comprises:

a non-concentric opening sized and dimensioned to seat the sinking-ball;

a limiting wall dimensioned and positioned to maintain the sinking-ball within a close proximity of the non-concentric opening when said check valve is open.

* * * * *